US007287922B2

(12) United States Patent
Buxton et al.

(10) Patent No.: US 7,287,922 B2
(45) Date of Patent: Oct. 30, 2007

(54) EXIT ROLLER SYSTEM FOR AN IMAGING APPARATUS INCLUDING BACKUP ROLLERS CONFIGURED TO REDUCE TRACKING

(75) Inventors: Patrick Andrew Buxton, Lexington, KY (US); Daniel Robert LaBar, Lexington, KY (US); Michael William Lawrence, Lexington, KY (US); Robert Michael Meadows, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 313 days.

(21) Appl. No.: 11/071,620

(22) Filed: Mar. 3, 2005

(65) Prior Publication Data

US 2006/0198684 A1 Sep. 7, 2006

(51) Int. Cl.
*B41J 13/02* (2006.01)
*B41J 13/08* (2006.01)

(52) U.S. Cl. ..... 400/636; 400/625; 400/641; 271/273; 347/104

(58) Field of Classification Search ..... None
See application file for complete search history.

(56) References Cited

U.S. PATENT DOCUMENTS

| | | | |
|---|---|---|---|
| 820,789 | A | 5/1906 | Hutchins |
| 1,128,789 | A | 2/1915 | Juengst |
| 1,141,098 | A | 6/1915 | Alquist |
| 2,862,400 | A | 12/1958 | D'Angelo |
| 2,975,504 | A | 3/1961 | Bentham |
| 3,213,704 | A | 10/1965 | McDougal |
| 3,680,185 | A | 8/1972 | Wood |
| 4,287,648 | A | 9/1981 | Hineborg et al. |
| 4,437,356 | A | 3/1984 | Imazaike |
| 4,802,396 | A | 2/1989 | Kuklinski |
| 4,852,482 | A | 8/1989 | Storace |
| 5,382,963 | A | 1/1995 | Pond et al. |
| 5,596,905 | A | 1/1997 | Kurosawa |
| 5,606,357 | A | 2/1997 | Bekki |
| 5,847,719 | A | 12/1998 | Yamaguchi et al. |
| 5,912,690 | A | 6/1999 | Endo et al. |
| 5,921,690 | A | 7/1999 | Shinmachi et al. |
| 6,007,063 | A | 12/1999 | Park |
| 6,059,287 | A | 5/2000 | Bae |
| 6,183,152 | B1 | 2/2001 | Kumai et al. |
| 6,223,578 | B1 | 5/2001 | Kamijo |
| 6,450,713 | B2 | 9/2002 | Parthasarathy et al. |
| 6,554,417 | B2 | 4/2003 | Lin et al. |
| 6,684,729 | B2 | 2/2004 | Bauseler |

FOREIGN PATENT DOCUMENTS

| | | | |
|---|---|---|---|
| DE | 2618942 | * | 11/1977 |
| JP | 2001122489 | * | 5/2001 |
| JP | 2002179319 | * | 5/2002 |

* cited by examiner

*Primary Examiner*—Daniel J. Colilla
*Assistant Examiner*—Marissa Ferguson-Samreth
(74) *Attorney, Agent, or Firm*—Taylor & Aust, P.C.

(57) ABSTRACT

A backup roller is formed by a member having a rotational axis and a circumferential region around which a plurality of teeth are arranged. Each tooth of the plurality of teeth has a tip end extending in a direction away from the rotational axis. When the backup roller is rotated the tip end of each of the plurality of teeth sequentially extends toward the rotational axis of a drive roller at an angle non-orthogonal to the rotational axis of the drive roller.

18 Claims, 5 Drawing Sheets

EXIT ROLLER SYSTEM FOR AN IMAGING APPARATUS INCLUDING BACKUP ROLLERS CONFIGURED TO REDUCE TRACKING

BACKGROUND OF THE INVENTION

1. Field of the Invention

The present invention relates to an imaging apparatus, and more particularly, to an exit roller system for an imaging apparatus including backup rollers configured to reduce tracking.

2. Description of the Related Art

An imaging apparatus, such as a multifunction device or printer, may include an ink jet print engine that forms an image on a sheet of print media, such as paper, by ejecting ink from a plurality of ink jetting nozzles of an ink jet printhead to form a pattern of ink dots on the sheet of print media. Such an ink jet print engine typically includes a reciprocating printhead carrier that transports one or more ink jet printheads across the print medium along a bi-directional scanning path defining a print zone of the printer. Typically, the mid-frame provides media support at or near the print zone. A sheet feeding mechanism is used to advance the print medium sheet in a sheet feed direction through the print zone between scans in the main scan direction, or after all data intended to be printed with the print medium at a particular stationary position has been completed.

One such sheet feed mechanism includes a feed roller, also sometimes referred to as an index roller, and a corresponding pinch roller arrangement located upstream of the print zone, and an exit roller and corresponding backup roller arrangement, such as a plurality of star wheels, located downstream of the print zone. Efforts have been made to reduce the star wheel tracking, i.e., leaving tracks, on a printed sheet that may occur, for example, when a star wheel passes through pigmented inks used with gel based photo papers. For example, one such approach in reducing tracking is to coat the surface finish of the star wheel tips to prevent the gel coating of the photo paper from adhering to the star wheel. A second approach is to remove material from one side of the tip portions of the star wheel, such as by a chemical etch process, to reduce the contact area of the tip with respect to the sheet of print media.

What is needed in the art is a simple and cost effective backup roller design that provides reduced tracking of the backup rollers on a sheet of print media.

SUMMARY OF THE INVENTION

The present invention relates to a backup roller design that provides reduced tracking of the star wheels on a sheet of print media.

The present invention, in one form thereof, is directed to an imaging apparatus for forming an image on a sheet of media. The imaging apparatus includes a drive roller positioned to convey the sheet of print media in a sheet feed direction, the drive roller having a first rotational axis. A backup roller is formed by a member having a second rotational axis and a circumferential region around which a plurality of teeth are arranged. Each tooth of the plurality of teeth has a tip end extending in a direction away from the second rotational axis. When the backup roller is rotated the tip end of each of the plurality of teeth sequentially extends toward the first rotational axis of the drive roller at an angle non-orthogonal to the first rotational axis.

The present invention, in another form thereof, is directed to a backup roller for use in an imaging apparatus to contact a sheet of media to aid in conveying the sheet of media. The backup roller includes a member having a rotational axis and a circumferential region. A plurality of teeth is arranged at the circumferential region around the rotational axis. Each tooth of the plurality of teeth has a first tip end that extends in a direction that is non-orthogonal to the rotational axis.

The present invention, in another form thereof, is directed to a method for making a star wheel. The method includes forming a disk having a disk portion and a circumferential area including a plurality of teeth; and bending each of the plurality of teeth to be outside a plane of the disk portion.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

The exemplifications set out herein illustrate embodiments of the invention, and such exemplifications are not to be construed as limiting the scope of the invention in any manner.

DETAILED DESCRIPTION OF THE INVENTION

Figure 1:
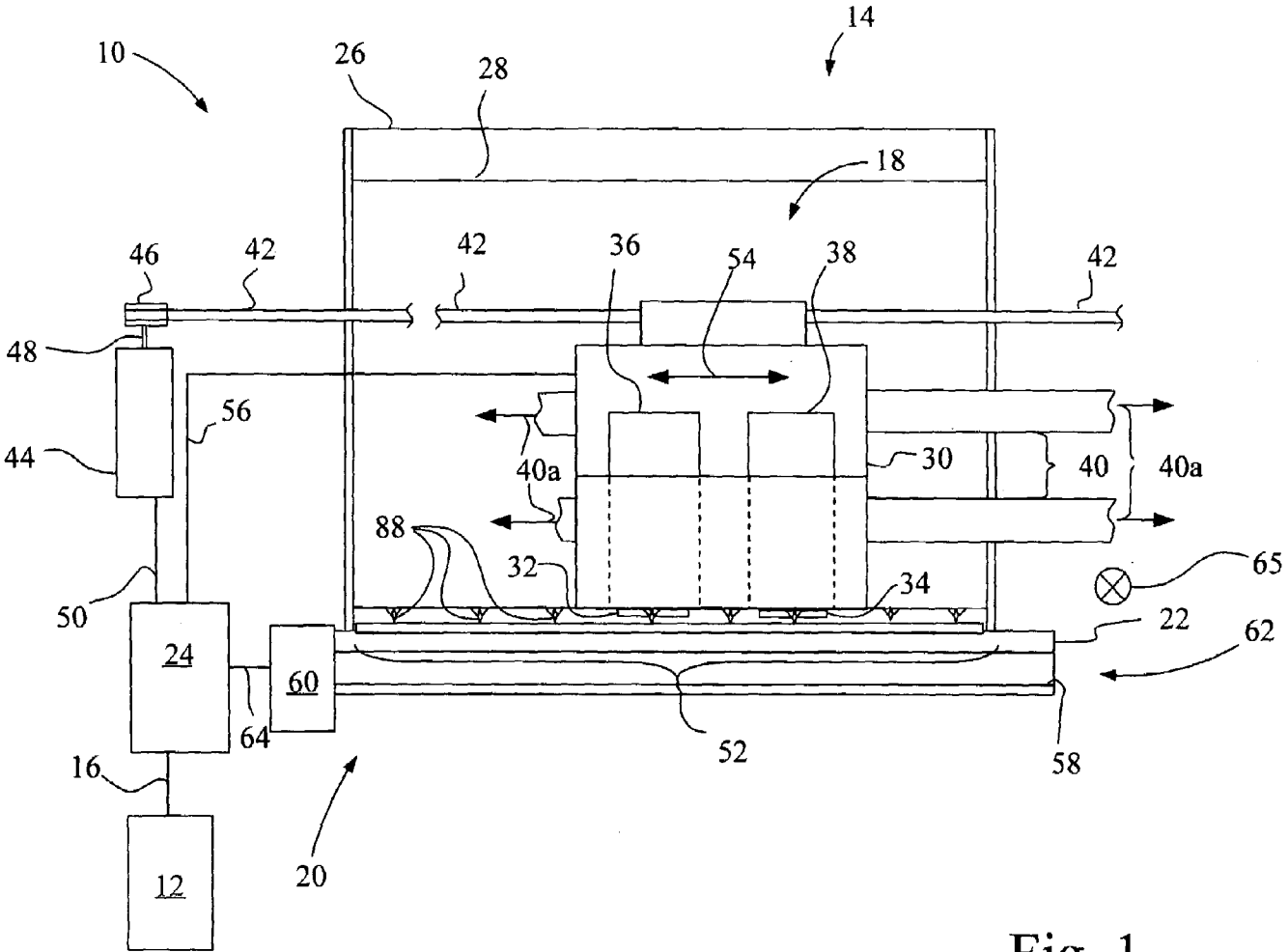
FIG. 1 is a diagrammatic representation of an imaging apparatus embodying the present invention.

Referring now to the drawings, and particularly to FIG. 1, there is shown an imaging system 10 embodying the present invention.

Imaging system 10 includes a host 12 and an imaging apparatus 14. Imaging apparatus 14 may be, for example, an ink jet printer, which in turn may form the print engine for a multi-function device (MFD), such as for example, a standalone unit that has scanning, copying, and/or faxing functionality, in addition to printing functionality. Host 12, which may be optional, may be communicatively coupled to imaging apparatus 14 via a communications link 16.

As used herein, the term "communications link" generally refers to structure that facilitates electronic communication between two components, and may operate using wired or wireless technology. Accordingly, communications link 16 may be, for example, a direct electrical wired connection, a direct wireless connection (e.g., infrared or r.f.), or a network connection (wired or wireless), such as for example, an Ethernet local area network (LAN) or a wireless networking standard, such as IEEE 802.11.

In embodiments including host 12, host 12 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During a printing operation, host 12 includes in its memory a software program including program instructions that function as a printer driver for imaging apparatus 14. The printer driver, for example, includes a halftoning unit and a data formatter that places print data and print commands in a format that can be recognized by imaging apparatus 14.

Imaging apparatus 14 includes a printhead carrier system 18, a print media feed system 20, a mid-frame 22, a controller 24, and a print media source 26.

Print media source 26 is configured and arranged to supply individual sheets of print media 28 to print media feed system 20, which in turn further transports the sheets of print media 28 during a printing operation.

Printhead carrier system 18 includes a printhead carrier 30 for carrying, for example, a color printhead 32 and monochrome printhead 34. A color ink reservoir 36 is provided in fluid communication with color printhead 32 and a monochrome ink reservoir 38 is provided in fluid communication with monochrome printhead 34. Reservoirs 36, 38 may be located near respective printheads 32 and 34, which in turn may be assembled as respective unitary cartridges. Alternatively, reservoirs 36, 38 may be located remote from printheads 32, 34, e.g., off-carrier, and reservoirs 36, 38 may be fluidly interconnected to printheads 32, 34, respectively, by fluid conduits.

Printhead carrier 30 is guided by a pair of guide members 40, such as for example, guide rods. Alternatively, one of guide rods could be a guide rail made of a flat material, such as metal. The axes 40*a* of guide rods 40 define a bidirectional-scanning path, also referred to as 40*a*, of printhead carrier 30. Printhead carrier 30 is connected to a carrier transport belt 42 that is driven by a carrier motor 44 by way of a driven carrier pulley 46. Carrier motor 44 has a rotating carrier motor shaft 48 that is attached to carrier pulley 46. Carrier motor 44 is electrically connected to controller 24 via communications link 50. At a directive of controller 24, printhead carrier 30 is transported, in a reciprocating manner, along guide rods 40. Carrier motor 44 may be, for example, a direct current motor or a stepper motor.

The reciprocation of printhead carrier 30 transports ink jet printheads 32 and 34 across the sheet of print media 28 along bidirectional scanning path 40*a* to define a print zone 52 of imaging apparatus 14 as a rectangular region. This reciprocation occurs in a main scan direction 54 that is parallel with bidirectional scanning path 40*a* and is also commonly referred to as the horizontal scanning direction. Printheads 32 and 34 are electrically connected to controller 24 via a communications link 56.

During each printing pass, i.e., scan, of printhead carrier 30, while ejecting ink from printheads 32 and/or 34, the sheet of print media 28 is held stationary by print media feed system 20. Before ink ejection begins for a subsequent pass, print media feed system 20 conveys the sheet of print media 28 in an incremental, i.e., indexed, fashion to advance the sheet of print media 28 in print zone 52. Following printing, the printed sheet of print media 28 is delivered by print media feed system 20 to a print media exit tray 58.

Print media feed system 20 includes a drive unit 60 coupled to a sheet conveying unit 62. Drive unit 60 is electrically connected to controller 24 via a communications link 64, and provides a rotational force which is supplied to sheet conveying unit 62. Drive unit 60 includes a motor, such as for example, a direct current (DC) motor, or alternatively, a stepper motor.

Figure 2:
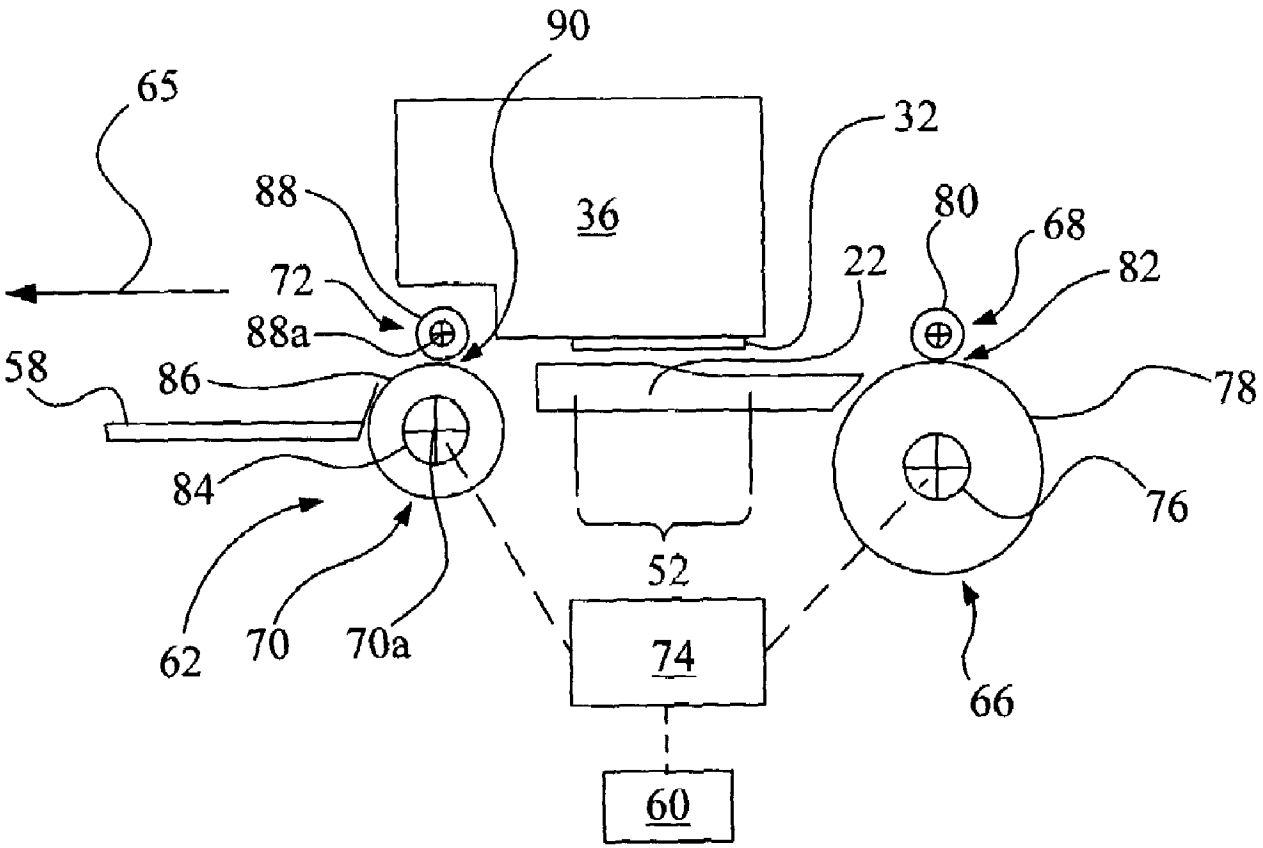
FIG. 2 is a side diagrammatic representation of the print media feed system of the imaging apparatus of FIG. 1.

Referring to FIG. 2, there is shown a diagrammatic representation of a portion of imaging apparatus 14 including sheet conveying unit 62 of print media feed system 20 for conveying the sheet of print media 28 in sheet feed direction 65. Sheet feed direction 65 is substantially orthogonal to main scan direction 54, and is sometimes referred to in the art as the sub-scan direction. In FIG. 1, sheet feed direction 65 is shown as an X in a circle to indicate that the direction is out of the plane of the paper toward the reader.

Sheet conveying unit 62 includes, for example, a feed roller 66, a pinch roller arrangement 68, an exit roller 70, and an exit backup roller arrangement 72. Feed roller 66 is drivably coupled to exit roller 70 via a drive train 74, which is schematically illustrated. Drive train 74 is drivably coupled to drive unit 60.

Feed roller 66 includes a shaft 76, such as a plastic or metal shaft, on which there is mounted a plurality of feed roller tires 78. Feed roller 66 is positioned to convey the sheet of print media 28 in sheet feed direction 65 through said print zone 52, toward exit roller 70 and exit backup roller arrangement 72. In FIG. 2, only one feed roller tire is shown. Each of the plurality of feed roller tires 78 may be formed, for example, from a rubber material. Pinch roller arrangement 68 may include a plurality of pinch rollers 80. In FIG. 2, only one pinch roller is shown. Each pinch roller 80 is positioned adjacent to a corresponding feed roller tire 78, and each pinch roller 80 may be individually spring biased toward the corresponding feed roller tire 78 to form a nip 82. Each of the plurality of pinch rollers 80 may be formed as a cylindrical roller, and may be made, for example, from metal or plastic.

Exit roller 70 and exit backup roller arrangement 72 are positioned to convey the sheet of print media 28 in sheet feed direction 65 through print zone 52 to exit tray 58. Exit roller 70, which is a drive roller, includes a rotational axis 70*a* and a shaft 84, such as a plastic or metal shaft, on which is mounted a plurality of exit roller tires 86. In FIG. 2, only one exit roller tire is shown. Each of the plurality of exit roller tires 86 may be formed, for example, from a rubber material.

Exit backup roller arrangement 72 may include a plurality of backup rollers 88 formed by a member, e.g., one or more disks, having a circumferential region around which a plurality of teeth are arranged, and accordingly, are sometimes referred to herein as star wheels. Each of the backup rollers 88 includes a rotational axis 88*a*, around which lies the circumferential region having the star wheel teeth. As shown in FIG. 1, the plurality of backup rollers 88 are spaced apart in the main scan direction 54. Each of the plurality of backup rollers 88 may be individually mounted, and positioned adjacent to a corresponding exit roller tire, and each of the plurality of backup rollers 88 may be individually spring biased toward the corresponding exit roller tire 86 to form a nip 90.

In accordance with the present invention, each of the plurality of backup rollers 88, including one or more star wheels, are configured and/or arranged to reduce the area of contact between the star wheel teeth and the sheet of print media 28, as described below with respect to the exemplary embodiments of FIGS. 3-8.

Figure 3:
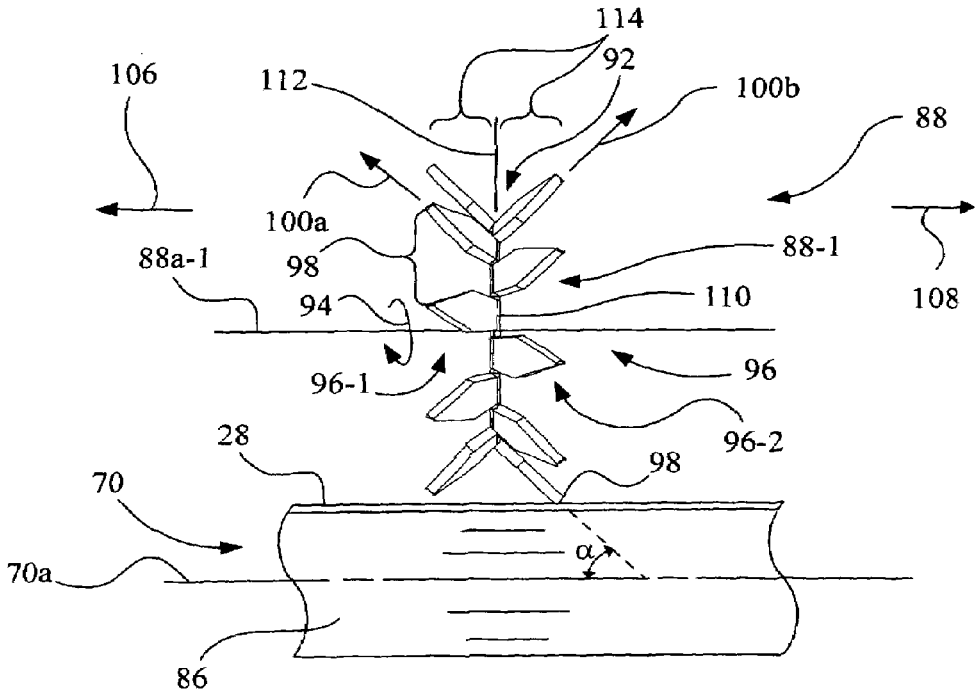
FIG. 3 is an end view of one embodiment of a backup roller configured in accordance with the present invention.

Referring now to FIG. 3, there is shown a first exemplary embodiment of backup roller 88, in the form of a star wheel 88-1. Star wheel 88-1 is formed by a member 92, such as a round disk, including a rotational axis 88*a*-1 and a circumferential region 94 (see also the generally round shape of backup roller 88 shown in FIG. 2) around which a plurality of teeth 96 are arranged. The plurality of teeth 96 have tip ends 98 that extend in directions 100*a*, 100*b* away from rotational axis 88*a*-1 and non-orthogonal to rotational axis 88*a*-1. When star wheel 88-1 is rotated, the tip end 98 of each of said plurality of teeth 96 sequentially extends toward rotational axis 70*a* of exit roller 70 at an angle α that is non-orthogonal to rotational axis 70*a* of exit roller 70. In one embodiment, for example, angle α may be in a range of about 25 degrees to about 85 degrees.

Figure 4:
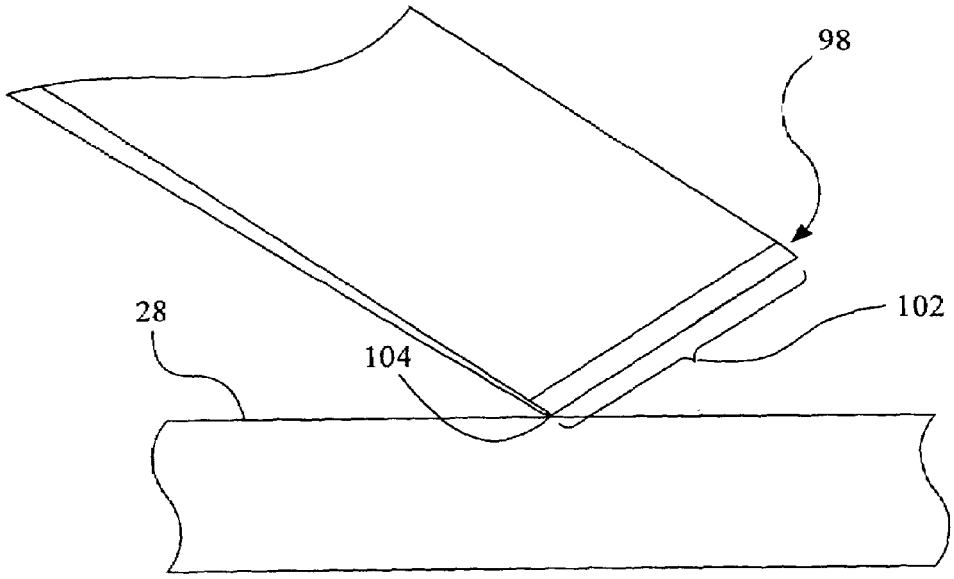
FIG. 4 is an enlarged partial perspective view showing a tip end of one of the plurality of teeth of the backup roller of FIG. 3 shown contacting a sheet of print media.

As shown in FIG. 4, the tip end 98 of one of the plurality of teeth 96 is shown contacting the sheet of print media 28, such that the entire point 102 of the tooth does not contact the sheet of print media 28, but rather, only the corner 104 of point 102 of the tooth contacts the sheet of print media 28, thereby reducing the area of contact between star wheel 88-1 and the sheet of print media 28.

In the embodiment of FIG. 3, the plurality of teeth 96 include a first plurality of teeth 96-1 and a second plurality of teeth 96-2. The first plurality of teeth 96-1 are bent in a first direction 106 and the second plurality of teeth 96-2 are bent in a second direction 108. As shown, the first plurality of teeth 96-1 and the second plurality of teeth 96-2 are alternatingly disposed around circumferential region 94, i.e., the bends of the plurality of teeth 96 alternate between direction 106 and direction 108 around circumferential region 94.

Member 92 includes a disk portion 110 that defines a plane 112 through which rotational axis 88*a*-1 intersects, and wherein plane 112 is orthogonal to rotational axis 88*a*-1. Each of the first plurality of teeth 96-1 and the second plurality of teeth 96-2 extends from the disk portion 110 of member 92 to a region 114 outside plane 112 of disk portion 110. For example, each of the first plurality of teeth 96-1 extend in direction 106 away from a first side of disk portion 110 and each of the second plurality of teeth 96-2 extend in direction 108 away from a second side of disk portion 110.

Star wheel 88-1 may be made, for example, by forming a disk, including disk portion 110, having a circumferential region 94 including a plurality of teeth 96, and bending each of the plurality of teeth 96 to be outside plane 112 of disk portion 110. The teeth, as shown in the embodiment of FIG. 3, may be alternatingly bent in opposite directions.

Figure 5:
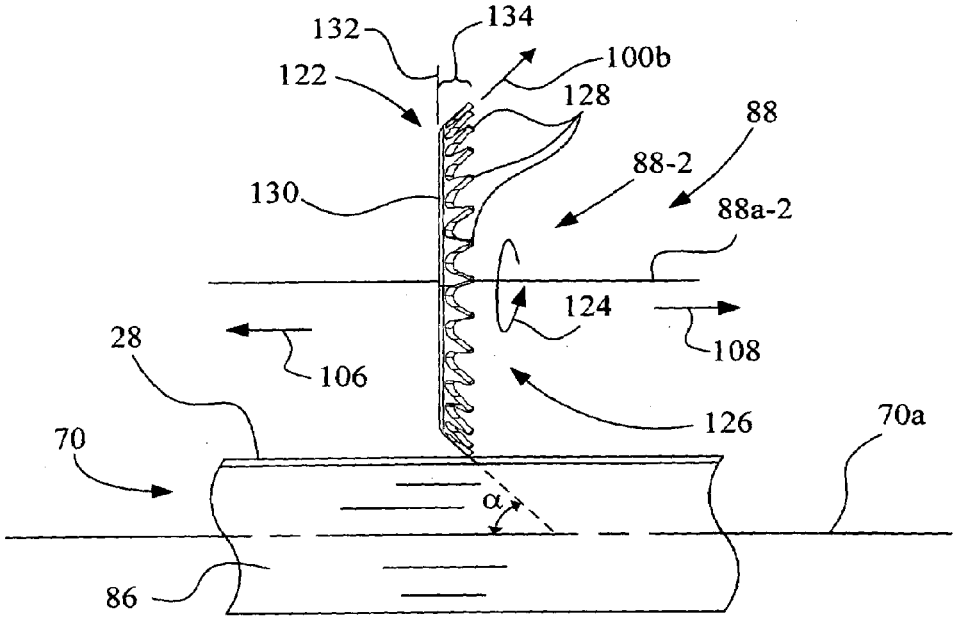
FIG. 5 is an end view of another embodiment of a backup roller configured in accordance with the present invention.

Referring now to FIG. 5, there is shown another exemplary embodiment of backup roller 88, in the form of a star wheel 88-2. Star wheel 88-2 is formed by a member 122, such as a round disk, including a rotational axis 88*a*-2 and a circumferential region 124 (see also the generally round shape of backup roller 88 shown in FIG. 2) around which a plurality of teeth 126 are arranged. The plurality of teeth 126 have tip ends 128 that extend in directions 100*b* away from rotational axis 88*a*-2 and non-orthogonal to rotational axis 88*a*-2. When star wheel 88-2 is rotated, the tip end 128 of each of said plurality of teeth 126 sequentially extends toward rotational axis 70*a* of exit roller 70 at an angle α that is non-orthogonal to rotational axis 70*a* of exit roller 70. In one embodiment, for example, angle α may be in a range of about 25 degrees to about 85 degrees.

Like that shown in FIG. 4, the entire point of each tip end 128 of the plurality of teeth 126 does not contact the sheet of print media 28, but rather, only a corner of the point of tip end 128 contacts the sheet of print media 28, thereby reducing the area of contact between star wheel 88-2 and the sheet of print media 28.

In the embodiment of FIG. 5, as shown, the plurality of teeth 126 are bent in direction 108. Member 122 includes a disk portion 130 that defines a plane 132 through which rotational axis 88*a*-2 intersects, wherein plane 132 is orthogonal to rotational axis 88*a*-2. Each of the plurality of teeth 126 extends from the disk portion 130 of member 122 to a region 134 outside plane 132 of disk portion 130. For example, each of the plurality of teeth 126 extends in direction 108 away from one side of disk portion 110.

Star wheel 88-2 may be made, for example, by forming a disk, including disk portion 130, having a circumferential region 124 including the plurality of teeth 126, and bending each of the plurality of teeth 126 to be outside plane 132 of disk portion 130.

Figure 6:
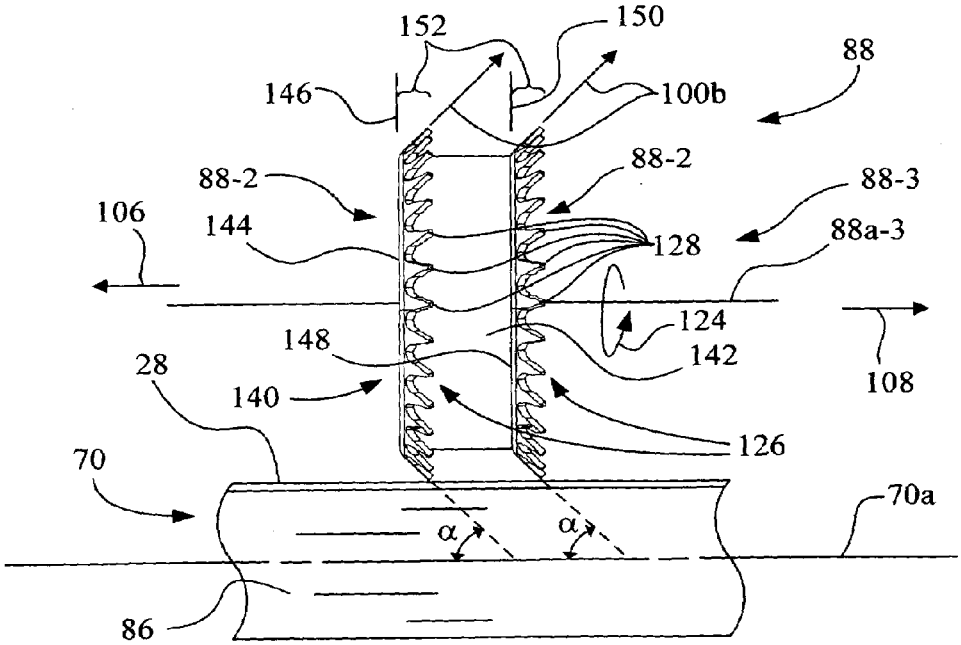
FIG. 6 is an end view of another embodiment of a backup roller configured in accordance with the present invention.

Referring now to FIG. 6, there is shown another exemplary embodiment of backup roller 88, in the form of a dual star wheel unit 88-3, including two star wheels, each being like star wheel 88-2 of FIG. 5. Dual star wheel unit 88-3 is formed by a member 140 including a rotational axis 88*a*-3, wherein each of the two star wheels 88-2 have a circumferential region 124 (see also the generally round shape of backup roller 88 shown in FIG. 2) around which a plurality of teeth 126 are arranged. The plurality of teeth 126 have tip ends 128 that extend in directions 100*b* away from rotational axis 88*a*-3 and non-orthogonal to rotational axis 88*a*-3. When dual star wheel unit 88-3 is rotated, the tip end of each of said plurality of teeth 126 sequentially extends toward rotational axis 70*a* of exit roller 70 at an angle α that is non-orthogonal to rotational axis 70*a* of exit roller 70. In one embodiment, for example, angle α may be in a range of about 25 degrees to about 85 degrees.

Member 140 includes a hub 142 having attached thereto a first disk portion 144 defining a first plane 146 through which rotational axis 88*a*-3 intersects and a second disk portion 148 defining a second plane 150 through which rotational axis 88*a*-3 intersects. Each of first plane 146 and second plane 150 is orthogonal to rotational axis 88*a*-3. First disk portion 144 is spaced apart from second disk portion 148 by a distance along rotational axis 88*a*-3.

Each of the plurality of teeth 126 that extend from disk portion 144, extend in directions 100*b* to a region 152 outside the first plane 146 of the first disk portion 144. Likewise, each of the plurality of teeth 126 that extend from disk portion 148 extend in directions 100*b* to region 152 outside the second plane 150 of the second disk portion 148. The plurality of teeth 126 of the left star wheel 88-2 and the plurality of teeth 126 of the right star wheel 88-2, as shown in FIG. 6, are bent in the same direction 108.

The interaction and orientation of each star wheel 88-2 with respect to the sheet of print media 28 is as described above with respect to FIG. 5.

Figure 7:
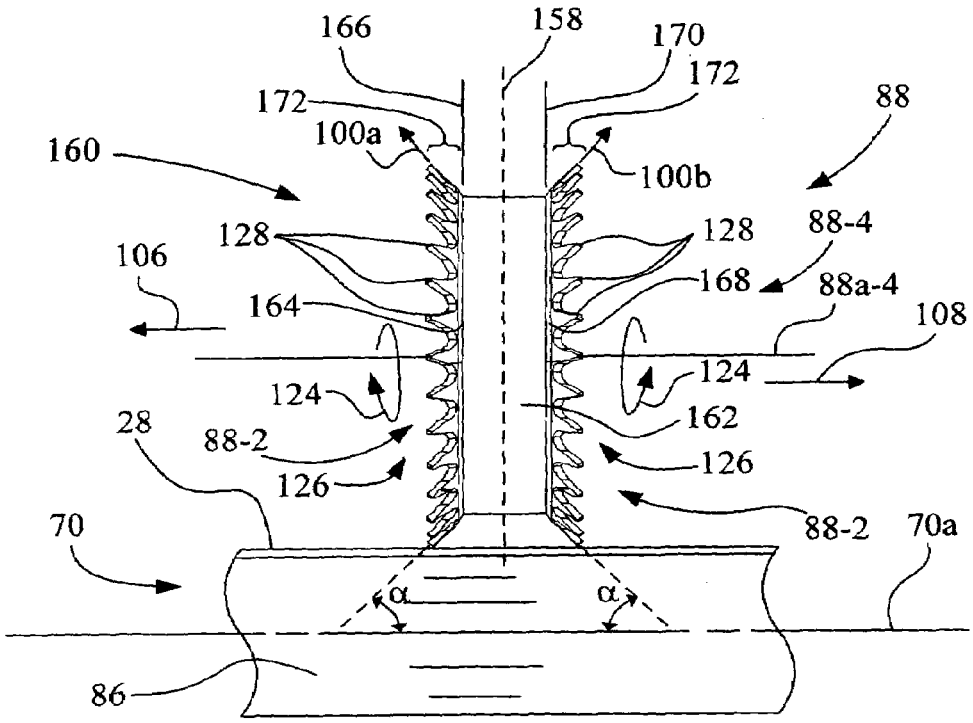
FIG. 7 is an end view of another embodiment of a backup roller configured in accordance with the present invention.

Referring now to FIG. 7, there is shown another exemplary embodiment of backup roller 88, in the form of a dual star wheel unit 88-4, including two star wheels, each being like star wheel 88-2 of FIG. 5, but arranged symmetrically with respect to a line of symmetry 158. Dual star wheels 88-4 are formed by a member 160 including a rotational axis 88*a*-4, wherein each of the two star wheels 88-2 have a circumferential region 124 (see also the generally round shape of backup roller 88 shown in FIG. 2) around which a plurality of teeth 126 are arranged. The plurality of teeth 126 have tip ends 128 that extend in directions 100*a*, 100*b* away from rotational axis 88*a*-4 and non-orthogonal to rotational axis 88*a*-4. When dual star wheel unit 88-4 is rotated, the tip end of each of said plurality of teeth 126 sequentially extends toward rotational axis 70*a* of exit roller 70 at an angle α that is non-orthogonal to rotational axis 70*a* of exit roller 70. In one embodiment, for example, angle α may be in a range of about 25 degrees to about 85 degrees.

Member 160 includes a hub 162 having attached thereto a first disk portion 164 defining a first plane 166 through which rotational axis 88*a*-4 intersects and a second disk portion 168 defining a second plane 170 through which rotational axis 88*a*-4 intersects. Each of first plane 166 and second plane 170 are orthogonal to rotational axis 88*a*-4. First disk portion 164 is spaced apart from second disk portion 168 by a distance along rotational axis 88*a*-4.

Each of the plurality of teeth 126 that extend from disk portion 164, extends in directions 100*a* to a region 172 outside the first plane 166 of the first disk portion 164. Likewise, each of the plurality of teeth 126 that extend from disk portion 168 extend in direction 100*b* to region 172 outside the second plane 170 of the second disk portion 168. The plurality of teeth 126 of the left star wheel 88-2 and the plurality of teeth 126 of the right star wheel 88-2, as shown in FIG. 7, are bent in opposite directions 106, 108.

The interaction and orientation of each star wheel 88-2 with respect to the sheet of print media 28 is as described above with respect to FIG. 5.

Figure 8:
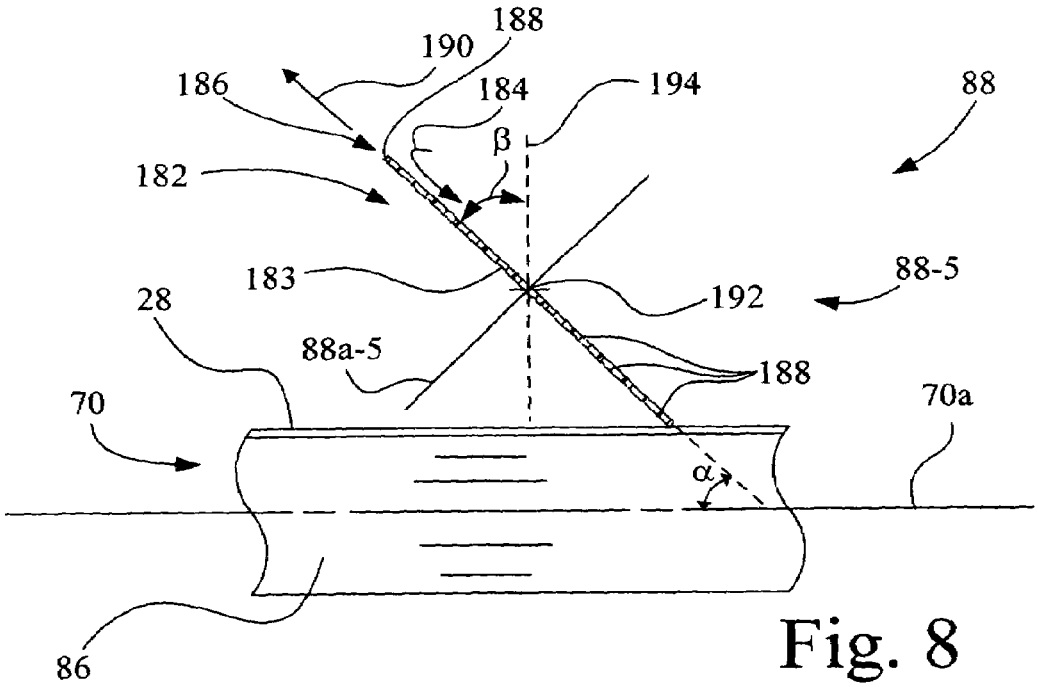
FIG. 8 is an end view of another embodiment of a backup roller configured in accordance with the present invention.

Referring now to FIG. 8, there is shown another exemplary embodiment of backup roller 88, in the form of a star wheel 88-5. Star wheel 88-5 is formed by a member 182, such as a round disk 183, including a rotational axis 88*a*-5 and a circumferential region 184 (see also the generally round shape of backup roller 88 shown in FIG. 2) around which a plurality of teeth 186 are arranged. The plurality of teeth have tip ends 188 that extend in directions 190 away from rotational axis 88*a*-5 and orthogonal to rotational axis 88*a*-5. When star wheel 88-5 is rotated, the tip end of each of said plurality of teeth 186 sequentially extends toward rotational axis 70*a* of exit roller 70 at an angle α that is non-orthogonal to rotational axis 70*a* of exit roller 70. In one embodiment, for example, angle α may be in a range of about 25 degrees to about 85 degrees.

Further, as shown in FIG. 8, the orientation of star wheel 88-5 is such that the rotational axis 88*a*-5 of star wheel 88-5 is pivoted about an axis 192 (shown as "+" to indicate a direction out of the plane of the paper toward the reader) that extends parallel to sheet feed direction 65 (see FIG. 2) to a position that is canted by a predetermined angle β with respect to a vertical line 194.

Like that shown in FIG. 4, the entire point of each tip end 188 of the plurality of teeth 186 does not contact the sheet of print media 28, but rather, only a corner of the point of tip end 188 contacts the sheet of print media 28, thereby reducing the area of contact between star wheel 88-5 and the sheet of print media 28.

While this invention has been described with respect to exemplary embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus for forming an image on a sheet of media, comprising:

a drive roller positioned to convey said sheet of media in a sheet feed direction, said drive roller having a first rotational axis; and a backup roller positioned adjacent said drive roller to engage said sheet of media, said backup roller and said drive roller forming a nip, said backup roller being formed by a member including a disk portion defining a plane, and having a second rotational axis extending through said disk portion and a circumferential region around which a plurality of teeth are arranged, wherein each tooth of said plurality of teeth has a tip end extending in a direction away from said second rotational axis and extending outwardly from said disk portion to a region outside said plane, and wherein when said backup roller is rotated said tip end of each of said plurality of teeth sequentially extends toward said first rotational axis of said drive roller at an angle non-orthogonal to said first rotational axis.

2. The imaging apparatus of claim 1, wherein said tip end of each tooth of said plurality of teeth extends in a direction that is non-orthogonal to said second rotational axis.

3. The imaging apparatus of claim 1, wherein said plurality of teeth include a first plurality of teeth and a second plurality of teeth, and wherein each tooth of said first plurality of teeth and said second plurality of teeth extend in directions that are non-orthogonal to said second rotational axis.

4. The imaging apparatus of claim 3, wherein said first plurality of teeth are bent in a first direction and said second plurality of teeth are bent in a second direction, said first plurality of teeth and said second plurality of teeth being alternatingly disposed around said circumferential region.

5. The imaging apparatus of claim 1, wherein said second rotational axis of said backup roller is pivoted about an axis extending in said sheet feed direction to a position that is canted by a predetermined angle with respect to vertical.

6. An imaging apparatus for forming an image on a sheet of media, comprising:

a drive roller positioned to convey said sheet of media in a sheet feed direction, said drive roller having a first rotational axis; and a backup roller positioned adjacent said drive roller to engage said sheet of media, said backup roller and said drive roller forming a nip, said backup roller being formed by a member having a second rotational axis and a circumferential region around which a plurality of teeth are arranged, wherein each tooth of said plurality of teeth has a tip end extending in a direction away from said second rotational axis, and wherein when said backup roller is rotated said tip end of each of said plurality of teeth sequentially extends toward said first rotational axis of said drive roller at an angle non-orthogonal to said first rotational axis, wherein said plurality of teeth include a first plurality of teeth and a second plurality of teeth, and wherein each tooth of said first plurality of teeth and said second plurality of teeth extend in directions that are non-orthogonal to said second rotational axis, and, said member including a disk portion defining a plane through which said second rotational axis intersects, said plane being orthogonal to said second rotational axis, wherein each of said first plurality of teeth and said second plurality of teeth extends from said disk portion to a region outside said plane of said disk portion.

7. The imaging apparatus of claim 6, wherein each of said first plurality of teeth extends in a direction away from a first side of said disk portion and each of said second plurality of teeth extends in a direction away from a second side of said disk portion.

8. An imaging apparatus for forming an image on a sheet of media, comprising:

a drive roller positioned to convey said sheet of media in a sheet feed direction, said drive roller having a first rotational axis; and a backup roller formed by a member having a second rotational axis and a circumferential region around which a plurality of teeth are arranged, wherein each tooth of said plurality of teeth has a tip end extending in a direction away from said second rotational axis, and wherein when said backup roller is rotated said tip end of each of said plurality of teeth sequentially extends toward said first rotational axis of said drive roller at an angle non-orthogonal to said first rotational axis, wherein said plurality of teeth include a first plurality of teeth and a second plurality of teeth, and wherein each tooth of said first plurality of teeth and said second plurality of teeth extend in directions that are non-orthogonal to said second rotational axis, and wherein said plurality of teeth include a first plurality of teeth and a second plurality of teeth, said member including a hub having attached thereto a first disk portion defining a first plane through which said second rotational axis intersects and a second disk portion defining a second plane through which said second rotational axis intersects, each of said first plane and said second plane being orthogonal to said second rotational axis, said first disk portion being spaced apart from said second disk portion along said second rotational axis, wherein each of said first plurality of teeth extends from said first disk portion to a region outside said first plane of said first disk portion, and wherein each of said second plurality of teeth extends from said second disk portion to a region outside said second plane of said second disk portion.

9. The imaging apparatus of claim 8, wherein said first plurality of teeth and said second plurality of teeth extend in the same directions.

10. The imaging apparatus of claim 8, wherein said first plurality of teeth and said second plurality of teeth extend in opposite directions.

11. A backup roller for use in an imaging apparatus to contact a sheet of media to aid in conveying said sheet of media, said backup roller comprising:

a member having a rotational axis and a circumferential region; and a first plurality of teeth arranged at said circumferential region around said rotational axis, each tooth of said first plurality of teeth having a first tip end extending in a direction that is non-orthogonal to said rotational axis, said member including a disk portion defining a plane through which said rotational axis intersects, said plane being orthogonal to said rotational axis, wherein each of said first plurality of teeth extends from said disk portion to a region outside said plane of said disk portion.

12. The backup roller of claim 11, further comprising a second plurality of teeth arranged at said circumferential region around said rotational axis, each tooth of said second plurality of teeth having a second tip end extending in a direction that is non-orthogonal to said rotational axis.

13. The backup roller of claim 12, wherein said first plurality of teeth are bent in a first direction and said second plurality of teeth are bent in a second direction, said first plurality of teeth and said second plurality of teeth being alternatingly disposed around said circumferential region.

14. The backup roller of claim 12, said member including a disk portion defining a plane through which said rotational axis intersects, said plane being orthogonal to said rotational axis, wherein each of said first plurality of teeth and said second plurality of teeth extends from said disk portion to a region outside said plane of said disk portion.

15. The backup roller of claim 14, wherein each of said first plurality of teeth extends in a direction away from a first side of said disk portion and each of said second plurality of teeth extends in a direction away from a second side of said disk portion.

16. A backup roller for use in an imaging apparatus to contact a sheet of media to aid in conveying said sheet of media, said backup roller comprising:

a member having a rotational axis and a circumferential region;

a first plurality of teeth arranged at said circumferential region around said rotational axis, each tooth of said first plurality of teeth having a first tip end extending in a direction that is non-orthogonal to said rotational axis; and a second plurality of teeth arranged at said circumferential region around said rotational axis, each tooth of said second plurality of teeth having a second tip end extending in a direction that is non-orthogonal to said rotational axis;

said member including a hub having attached thereto a first disk portion defining a first plane through which said rotational axis intersects and a second disk portion defining a second plane through which said rotational axis intersects, each of said first plane and said second plane being orthogonal to said rotational axis, said first disk portion being spaced apart from said second disk portion along said rotational axis, wherein each of said first plurality of teeth extends from said first disk portion to a region outside said first plane of said first disk portion, and wherein each of said second plurality of teeth extends from said second disk portion to a region outside said second plane of said second disk portion.

17. The backup roller of claim 16, wherein said first plurality of teeth and said second plurality of teeth extend in the same directions.

18. The backup roller of claim 16, wherein said first plurality of teeth and said second plurality of teeth extend in opposite directions.

* * * * *